US007104403B1

(12) United States Patent
Stephens et al.

(10) Patent No.: US 7,104,403 B1
(45) Date of Patent: Sep. 12, 2006

(54) STATIC TWO STAGE AIR CLASSIFIER

(75) Inventors: David L. Stephens, Peterborough (CA); Gerald G. Verret, St-Hippolyte (CA); Richard U. Lalancette, Val Morin (CA)

(73) Assignee: The Unimin Corporation, Peterborough (CA)

( * ) Notice: Subject to any disclaimer, the term of this patent is extended or adjusted under 35 U.S.C. 154(b) by 379 days.

(21) Appl. No.: 10/230,323

(22) Filed: Aug. 29, 2002

Related U.S. Application Data

(63) Continuation of application No. 09/746,446, filed on Dec. 20, 2000, now abandoned.

(51) Int. Cl.
*B07B 9/00* (2006.01)

(52) U.S. Cl. ..... 209/20; 209/21; 209/24; 209/28; 209/30; 209/32; 209/36; 209/132; 209/134; 209/138; 209/139.1

(58) Field of Classification Search ..... 209/20, 209/21, 24, 28, 30, 32, 36, 132, 134, 138, 209/139.1
See application file for complete search history.

(56) References Cited

U.S. PATENT DOCUMENTS

| | | | | | |
|---|---|---|---|---|---|
| 207,236 | A | | 8/1878 | Barnard | |
| 9,706 | A | | 5/1881 | Fender | |
| 251,883 | A | | 1/1882 | Holmes | |
| 372,015 | A | | 10/1887 | Davis | |
| 402,440 | A | * | 4/1889 | Haggenmacher | 209/137 |
| 519,958 | A | * | 5/1894 | Hueffher et al. | 209/137 |
| 619,482 | A | * | 2/1899 | Higginbottom | 209/139.1 |
| 1,034,792 | A | | 8/1912 | Hartman et al. | |
| 1,066,918 | A | | 7/1913 | Kidder | |
| 1,076,397 | A | * | 10/1913 | Stewart et al. | 209/44 |
| 1,191,568 | A | * | 7/1916 | Clay | 209/210 |
| 2,027,782 | A | * | 1/1936 | Lundgren | 241/61 |
| 2,210,103 | A | * | 8/1940 | Stoner | 209/31 |
| 2,602,595 | A | * | 7/1952 | Thomas | 241/39 |
| 2,765,079 | A | * | 10/1956 | Franken | 209/250 |
| 3,044,619 | A | | 7/1962 | Krolie | |

(Continued)

FOREIGN PATENT DOCUMENTS

| | | | | |
|---|---|---|---|---|
| DE | 356813 | * | 7/1922 | 209/135 |
| FR | 324817 | | 4/1902 | |
| GB | 496 | * | 1/1911 | 209/135 |
| GB | 358329 | | 10/1931 | |
| GB | 515058 | | 11/1939 | |
| GB | 740128 | * | 11/1955 | 209/135 |
| SU | 1002051 | | 3/1983 | |
| SU | 1034794 A | * | 8/1983 | |
| SU | 1222326 | | 4/1986 | |
| SU | 1459736 | | 2/1989 | |

*Primary Examiner*—Donald P. Walsh
*Assistant Examiner*—Matthew J. Kohner
(74) *Attorney, Agent, or Firm*—Fay Sharpe Fagan Minnich & McKee; Brian E. Turung; Robert V. Vickers

(57) ABSTRACT

A two-stage static air classifier has a feed duct through which particles of a granular mixture fall. A classifying louver plate having fins forming upwardly inclined classifying channels is fitted into a side opening in the feed duct. Particles of a set size are drawn by air suction through the classifying channels in the first stage. A separator box having an inlet connected to the outlet of the classifying channels collects the separated particles in a second stage as the entrained particles fall by gravity to the bottom of the separator box while the air streams drawing the particles through the classifying channels pass out the top end of the box. Adjustable baffle plates transversely extending through the box permit control of the quantity of fines collected with the particles at the separator box bottom. Size of the collected particles is determined by the speed of a fan at the top outlet of the separator box.

76 Claims, 8 Drawing Sheets

U.S. PATENT DOCUMENTS 3,288,284 A 11/1966 Manley
3,612,271 A 10/1971 Behling
3,720,307 A 3/1973 Hukki
3,799,339 A 3/1974 Breitholz et al.
3,992,177 A * 11/1976 Welteroth ..... 55/288
4,022,439 A 5/1977 Groth
4,133,749 A * 1/1979 Jelinek et al. ..... 209/24
4,242,197 A 12/1980 Voelskow et al.
4,519,896 A 5/1985 Vickery
4,655,804 A * 4/1987 Kercheval et al. ..... 55/324
4,759,840 A 7/1988 McIntyre et al.
4,865,721 A 9/1989 Smith et al.
4,950,388 A 8/1990 Stafford
5,032,256 A 7/1991 Vickery
5,429,248 A 7/1995 Le Gigan et al.
5,732,829 A 3/1998 Smith
5,871,103 A 2/1999 Durst
6,146,433 A * 11/2000 Bitner ..... 55/321

* cited by examiner

STATIC TWO STAGE AIR CLASSIFIER

This application is a continuation of Ser. No. 09/746,446, filed Dec. 20, 2000 now abandoned.

This invention relates generally to method and apparatus for classifying granular products by size and more particularly to systems which classifying particles by means of air flow.

This invention is particularly applicable to and will be described with specific reference to an air classifier system for sand, particularly silica sand used in industrial processes or in golf course sand traps. However, the invention has broader application and may be used in any system in which particles of a granular, homogenous substance must be classified or separated by size such as, for example, grain, pulverized coal, seeds, etc.

BACKGROUND

As a general definition, separating deices can be broadly divided into sorting devices which separate granular mixtures that contain different materials of different densities and classifying devices which separate particles of a homogeneous granular mixture by size (i.e., mixture comprised of particles having the same density). Conceptually, a sorting device must first classify the non-homogeneous particles of the granular mixture into similarly sized particles usually by screening and then separate the particles by their weight or density differences. This invention relates to classifiers for sorting or separating essentially homogeneous granular mixtures by particle size.

The typical, commercial method for separating or classifying particles in a granular mixture into various sizes is to simply pass the particles through screens through desired grid sizes. Because the grids plug, any number of devices or techniques are employed to unplug or minimize clogging of the screen grid. For example, air jets can be periodically or continuously blown through the screen grids or the screens are continuously vibrated or scraped or brushed. Also, special structures can be constructed so that the screens or the particles can be moved relative to one another to prevent screen plugging such as shown in U.S. Pat. No. 5,429,248 to Le Gigan et al. issued Jul. 4, 1995 in which tubular screens rotate while the granular mixture falls thereon. All such classifying devices have the potential for failure if the screens are blocked. Further, such classifying devices invariably have moving parts or mechanisms which are prone to or suspect of failure in the harsh environment of a granular mixture that inevitably produces or includes dust particles and fines.

The prior art has long recognized the plugging problems associated with screen classifiers discussed above and has developed classifiers which utilize air pressure and flow to separate particles by size. Examples of such devices can be found in U.S. Pat. No. 3,799,339 to Breitholtz et al.; issued Mar. 26, 1974; U.S. Pat. No. 4,519,896 to Vickery issued May 28, 1985; U.S. Pat. No. 4,950,388 to Stafford issued Aug. 21, 1990; U.S. Pat. No. 5,032,256 to Vickery issued Jul. 16, 1991; U.S. Pat. No. 5,732,829 to Smith issued Mar. 31, 1998 and U.S. Pat. No. 5,871,103 to Durst issued Feb. 16, 1999. Essentially, in these devices the granular mixture falls vertically by gravity across a horizontal stream or flow of air. The particles become entrained in the air stream and are carried horizontally some distance. The entrained large particles weigh more than the smaller particles, accelerate more slowing in the air stream and drop out of the air stream (by gravity) quicker and at a shorter horizontal distance from the point where the granular mixture was initially contacted by the air stream than the smaller particles. By positioning hoppers or receptacles at set horizontal distances, particles of different sizes can be collected. Conceptually, screens and moving parts are eliminated although a number of the patents cited use systems which employ moving components. However, such horizontal air tunnel classifiers are difficult to control. For example, the overall variation in the particle size of the granular mixture can be such that a predominance of larger particles in one granular mixture black can distort the drop point when compared to another granular mixture batch having a predominance of smaller particle sizes. Additionally, many of the cited patents discuss laminar flow and include provisions or adjusting mechanisms in the air feed to assure laminar flow. The cited patents use arrangements which push or blow the air into the granular mixture to entrain or suspend the particles. "Pushed" air streams at low, laminar flow velocities are not stable and when the low velocities have to be slightly varied to allow particles within a set discriminatory size range to drop out of the air streams at set distances, controllability issues are present.

Variations of the horizontal tunnel air classifiers discussed above exist in the patent art. In U.S. Pat. No. 4,759,840 to McIntyre et al. issued Jul. 26, 1988 a recirculating, filtered fan arrangement is shown to develop turbulent and laminar air streams which sequentially impact the granular mixture. In U.S. Pat. No. 3,612,271 to Behling issued Oct. 12, 1971 a push-pull fan arrangement is disclosed to suck lighter capsules from completely filled capsules. In U.S. Pat. No. 3,044,619 to Knolle issued Jul. 17, 1962 the particles are separated by a screen for size and then generally horizontally flow past air streams where they are blown upward. The upward air streams impart a trajectory to the particles which fall into horizontally placed receptacles. For the specific applications to which such patents are directed, there may be improved operational results compared to the conventional horizontal air tunnel arrangements discussed above although control and stability remain a concern.

SUMMARY OF THE INVENTION

It is thus a principle object of the invention to provide a static air classifier (without classifying screens or moving parts) which is stable and consistent in operation.

This object along with other features of the invention is achieved in a device for separating and classifying particles of a homogeneous granular mixture which includes a generally vertically extending, open ended feed duct having a feed inlet at its top, an oversized discharge outlet at its bottom, a side exit opening in-between the duct's ends and a side air inlet opening generally aligned or in registry with the side exit opening on the opposite side of the duct. A feeder such as a vibratory feeder is provided for depositing a particle stream of the granular mixture into the duct at its feed inlet so that the granular mixture falls by gravity to the oversized discharge outlet. A separator box is provided adjacent the feed duct and has a top section with a dust collector outlet, a bottom section with a classifier outlet and an intermediate section therebetween with the bottom section of the separator box having a box inlet connected to the side exit opening of the feed duct. A classifying louver plate having a plurality of upwardly extending fins which define vertically inclined classifying channels between adjacent fins horizontally extends from the side exit opening of the feed duct to the separator box inlet. A fan adjacent the duct collector outlet is provided for pulling air from the duct air inlet opening through the classifying passages whereat particles beyond a preset size impinge the fins and fall back by gravity into the granular mixture in a first separating stage while particles less than the preset size remain entrained within the air flow and enter the separator box where the particles fall by gravity into the classifier outlet in a second collecting stage. By sizing the separator box and classifying plate flow areas, separation and collection of separated particles occurs in a stable manner by drawing air through the classifier and the rate at which the air is drawn can be variably set for collecting particles within desired size ranges.

In accordance with another aspect of the invention, the intermediate box section longitudinally extends in a generally vertical direction and includes a plurality of spaced baffle plates transversely extending across the intermediate box section. Each baffle plate is rotatable about a center which is positioned to lie in a vertically inclined plane. The baffle plates act as transversely speed impingement devices to insure that the air flow is thoroughly distributed across the intermediate box section and control air flow or velocity in the separator box to allow the separated particles to drop out of the air stream in the separator box and fall by gravity into the classifier outlet. More particularly, by adjusting the baffles to set positions, the content or quantity of fines (inherently present in the granular mixture) collected in the classifying outlet along with the separated particles can be controlled.

In accordance with yet another aspect of the invention, the vertically lower most baffle plate in the baffle plate plurality is spaced furthest from the box inlet opening and the vertically highest baffle in the baffle plate plurality is spaced closest to the box inlet opening with the centers of the baffle plates lying in a linear plane whereby the distance from box inlet opening to any baffle is made somewhat uniform producing an equalized air flow throughout the cross-sectional flow area of the separator box.

In accordance with an important aspect of the invention, a critical parameter affecting the ability of the classifying louver plate to separate particles of a desired size in the granular mixture is the channel incline angle (the angle of the channel relative to the air flow direction drawn into the channel, i.e., horizontal in the preferred embodiment) which must be at least 55° and preferably at least 70° to the horizontal in a direction opposite that of the vertically falling particles in the feed duct. It has been discovered that with this geometry, variations only in velocity of the air flow drawn through the classifying channels (i.e., underpressure in the separator box established by fan rotational speed) is sufficient to collect particles of different sizes.

In accordance with a specific aspect of the invention, the box bottom section has a generally rectangular flanged opening at the top vertical end thereof with the classifier outlet being at the bottom vertical end. Transverse side walls extend vertically between the flanged opening and classifier outlet. A far end wall and a near end wall in-between the ends of the side walls vertically extend between the flanged opening and classifier outlet to close the box bottom section with the near end wall having the separator box inlet therein. A plurality of sand collecting ribs is provided in the interior of far end wall and extend between the side walls to prevent premature wear failure of the bottom section of the separator box otherwise resulting from impingement by the particular entrained in the air streams exiting the classifying channels of the classifying louver plate.

In accordance with another aspect of the invention, a two stage method is provided for classifying particles of a granular medium. In the first inventive stage, the method includes the steps or acts of causing a stream of a granular, generally homogeneous medium having various sizes of particles to flow past a vertically extending opening. Inserted in the opening is a classifying louver plate having fins extending from one side of the plate at an angle of at least 55° to the horizontal which form vertically inclined classifying channels between adjacent fins. Streams of air with entrained particles are drawn through the classifying channels causing entrained particles of a first size or larger to impinge the fins, separate from the air streams and fall back into the stream of granular medium passing by the vertically extending opening while particles of a smaller size remain entrained within the air streams and are drawn upwardly in the channels in direction opposite to that of the particles falling through the duct and pass through the classifying channels. By controlling the velocity of the air drawn through the classifying louver plate, the sizes of particles passing through the louver plate can be controlled so that particles of a size greater than that of a set size fall back into the feed duct.

In the second inventive stage of the method, the air streams with the smaller particles passing through the classifying channels continue to be drawn upwardly in a separator box attached to the outlet of the classifying channels which separator box has a dust collector outlet at its top and a classifier outlet at its bottom. Because the cross-sectional flow area of the separator box is significantly larger than the cross-sectional flow area of the classifying channels, the upward velocity of the air streams in the separator box is reduced to permit the smaller size particles to drop by weight into the classifier outlet for collection. By controlling velocity flow in the separator box the quantity of particles smaller than the maximum size of separated particles passing through the classifying louver plate can be controlled, i.e., particle size range.

In accordance with another important aspect of the inventive method of the present invention, the air streams are passed, in the second stage, between and against a plurality of baffle plates as the air streams are drawn upwardly in the separated box. The baffle plates are spaced from one another a set distance and adjustable so that a set percentage of the flow of the air streams with entrained separated particles impinge the baffles while air flow or velocity downstream and upstream of the baffles in the separator box is controlled. By setting the baffle plates at a set angle for a given fan speed the quantity of the fines collected with the separated particles at the classifier outlet can be controlled, i.e., the size range of smaller particles collected.

It is thus an object of the invention to provide an air classifier totally devoid of moving parts.

It is another object of the invention to provide a stable and efficient air classifier.

Yet another object of the invention is to provide an air classifier system capable of classifying particles within precise sizes that can be controlled within precise size ranges by simply regulating fan speed.

A still further object of the invention is to provide a two stage, adjustable static air classifier in which the particle size is separated in a first stage so that particles less than a set size are sorted out from the granular mixture and the separated particles within a size range are collected in a second stage.

A still further object of the invention in conjunction with the immediately preceding object is the provision of a two stage classifier which controls the content of fines collected in the separated particles of the granular medium in the second stage.

Still another object of the invention is to provide a static air classifier which is easily maintained and constructed for a long life.

Still yet another object of the invention is to provide an air classifier system which is simple and inexpensive.

These and other objects of the invention will become apparent to those skilled in the art upon reading and understanding the Detailed Description of the Invention as set forth below taken in conjunction with the drawings.

BRIEF DESCRIPTION OF THE DRAWINGS

The invention may take form in certain parts and in an arrangement of certain parts taken together and in conjunction with the attached drawings which form part of the invention and wherein.

DETAILED DESCRIPTION OF THE INVENTION

Figure 1:
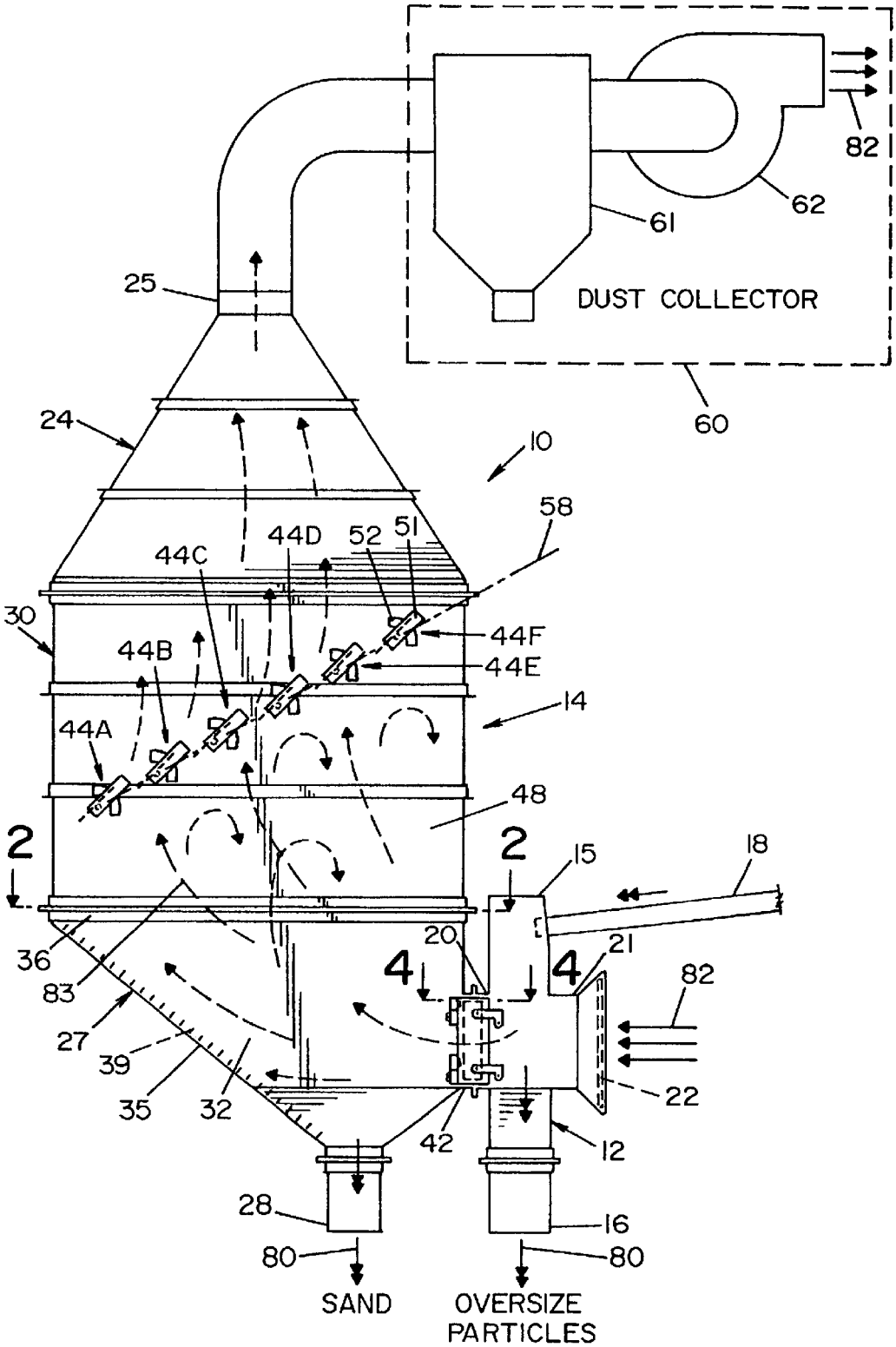
FIG. 1 is an elevation view of the air classifier of the present invention.

Referring now to the drawings wherein the showings are for the purpose of illustrating a preferred embodiment of the invention only and not for the purpose of limiting the same, there is shown in FIG. 1 an air classifier 10 of the invention.

In the preferred embodiment, air classifier 10 separates by size or "classifies" a granular mixture substantially comprising silica sand particles. For consistency in terminology only and when used in the specifications hereof to define the invention, "granular mixture" will refer to a substance comprising a plurality of discrete "particles" having various sizes and shapes even though technically there may be no difference between a "granule" and a "particle". The granular mixture is homogeneous in the sense that all the particles are substantially of the same material (technically, the same density) albeit different size. At noted above, granular mixtures comprising particles of the same material other than silicon sand can be separated by size by air classifier 10 so the invention is not limited to sand. It is also noted that granular mixtures, particularly of raw materials, include fines and dust particles. While semantically "fine" and "dust" may be used interchangeably, in this specification "fines" means very small particles of the granular substance or material being classified in relation to the particle size being classified while dust particles includes extraneous matter of small size as well as the granular raw material in sizes smaller than that generally termed as fines.

Air classifier 10 generally comprises a vertically extending feed duct 12 and adjacent thereto a separator box 14.

Feed duct 12 is open ended and has a feed duct inlet 15 at its top and an oversized discharge outlet 16 at its bottom. A stream of granular mixture is conveyed by a feeder 18 to feed duct inlet 15 and the granular mixture falls by gravity to oversized discharge outlet 16. In the preferred embodiment, feeder 18 is a conventional vibratory conveyor although other known feed arrangements can be used. In-between feed duct inlet 15 and oversize discharge outlet 16 is a side duct exit opening 20 at one side of feed duct 12 which is generally aligned with or generally in registry with a similarly sized side air inlet opening 21 on the opposite side of feed duct 12. Inserted inside air inlet opening 21 is a wire mesh screen 22 shown in dash-line in FIG. 1. Screen 22 serves as a guard preventing the granular mixture from inadvertently exiting through side air inlet opening 21 should oversized discharge outlet 16 become plugged. Additionally, screen 22 prevents large sized foreign objects from entering feed duct 12 which, in the environment of an air classifier, is believed prudent. Screen 22 provides no separating or classifying function and, in practice, does not become plugged or clogged and generally speaking, does not require maintenance.

While the configuration of feed duct 12 is not especially critical to the operation of the invention, side duct exit opening 20 is to be dimensioned or controlled in size relative to the sizing of other components of air classifier 10 and side air inlet opening 21 should be sized to be at least about equal to and preferably, greater than, the opening of side duct exit opening 20. For the prototype unit on which the specifications of this patent is based, feed duct 12 is rectangular in cross-section and side duct exit opening 22 is approximately 2 feet high by 4 feed deep, and has a cross-sectional flow area of about 8 $ft^2$.

Adjacent feed duct 12 and in communication therewith is separator box 14 which has a top section 24 with a dust collector outlet 25 at its top, a bottom section 27 with a classifier outlet 28, and an intermediate section 30 in-between top and bottom sections 24, 27.

In the preferred embodiment, intermediate section 30 is rectangular in cross-section at its bottom with a width (shown in the view of FIG. 1) of about 8 feet and a depth of about 4 feet (as can be seen from FIG. 2) and longitudinally extends for a vertical height about 7 feet. The cross-sectional area of the intermediate section 30 of separator box 14 through which air streams flow (as will be explained later) is thus, in the prototype preferred embodiment, 8"×4' or 32 $ft^2$. The vertical ends of intermediate section 30 are flanged and mate with corresponding flanges of top and bottom sections 24, 27 to form separator box 14.

Top section 24 is pyramidal in configuration with its base secured by its bottom flange to the uppermost flange of intermediate section 30. In fact, in the preferred embodiment, top section 24 is made up of several flange sections as shown in FIG. 1. In the embodiment disclosed, the base or bottom of top section 24 is the same in cross-sectional area as that of intermediate section 30 as described. The top or duct collector outlet 25 of top section 24, in the embodiment shown, is square with sides of about 1½ feet and the vertical length of the frusto-conical section is about 6 feet.

Figure 2:
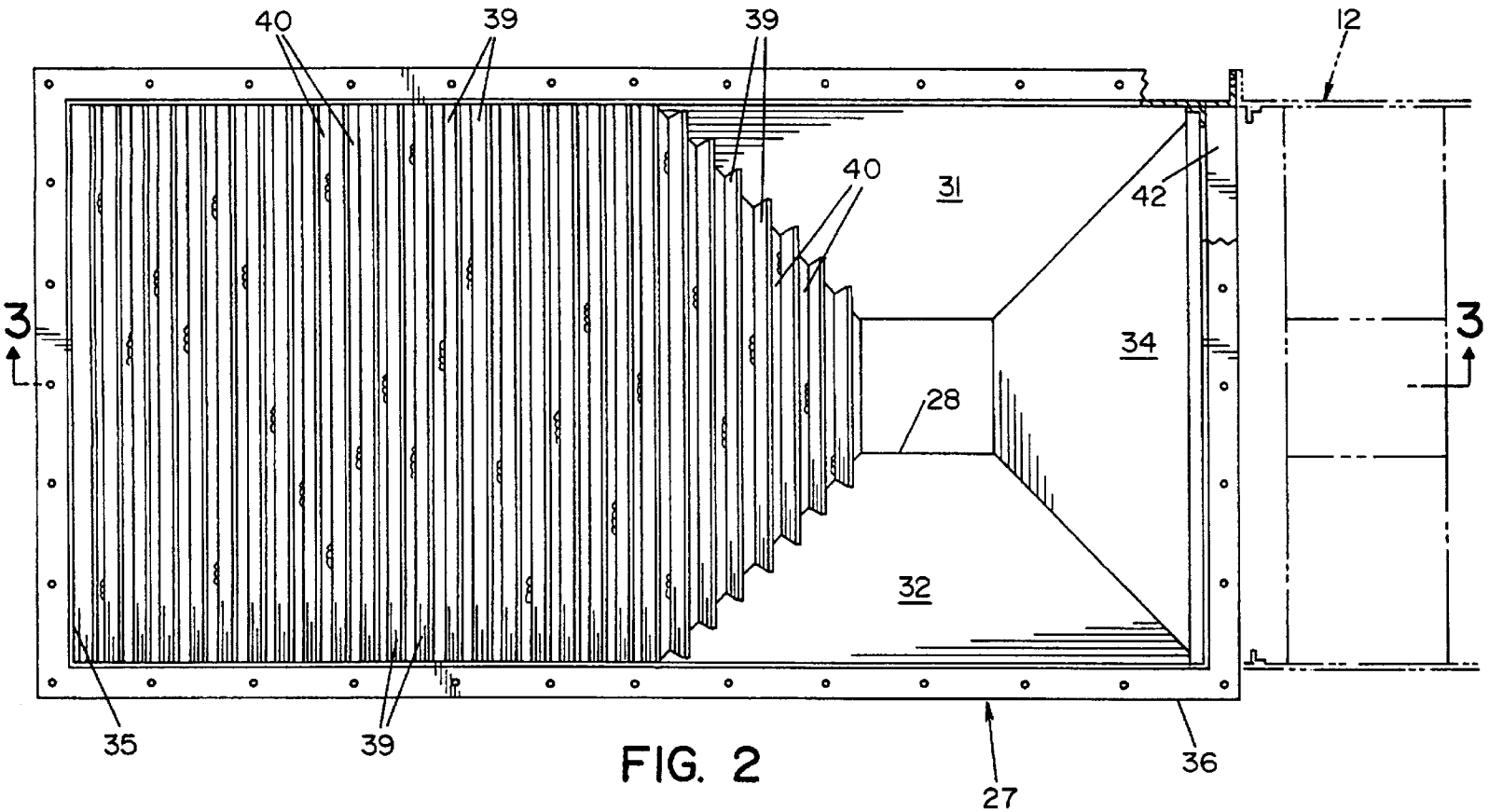
FIG. 2 is a plan view of the separator box of the present invention taken along lines 2—2 of FIG. 1.
Figure 3:
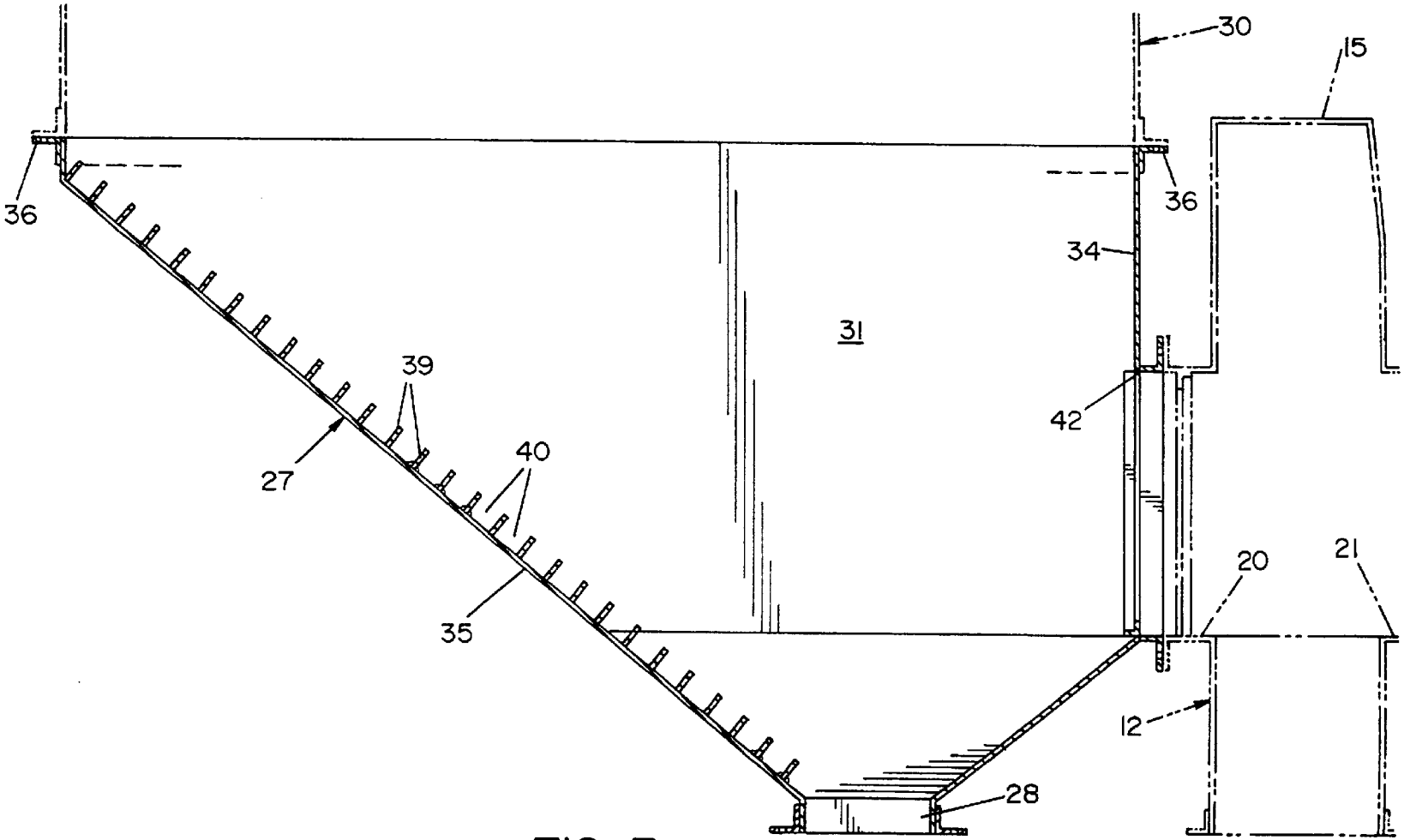
FIG. 3 is a section view of the bottom section of the separator box of the present invention taken along lines 3—3 of FIG. 2.

Referring now to FIGS. 2 and 3, bottom section 27 is formed by two vertically extending side walls 31, 32 which at their ends, are joined to a near end wall 34 and a far end wall 35. The top of bottom section 27 is formed with a flange 36 to be fastened to the flange at the bottom of intermediate section 30 and, in the embodiment illustrated, having the dimensions of the cross-section of intermediate section 30. Side walls 31, 32 are somewhat funneled and the near and far end walls 34, 35 are somewhat tapered to produce at the bottom of bottom section 27 discharge classifier outlet 28 which, in the embodiment illustrated, is a square duct having sides of about 1½ feet. In the embodiment illustrated, vertical height of bottom section 27 is approximately 5 feet and the frusto-conical angle of end walls 34, 35 as shown in FIGS. 1, 2 and 3 is approximately 40°. Formed on the interior surface of far end wall 35 and extending between side walls 31, 32 is a plurality of ridges 39 forming particle receiving troughs or channels 40. Troughs 40 become filled with separated particles when classifier 10 is in operation and prevent abrasive wear of far end wall 35 which would otherwise occur by the constant impingement and sliding action of particles entering separator box 14. Formed within near end wall 34 is a separator box inlet 42 which is in alignment and registry with side duct exit opening 20.

Figure 6:
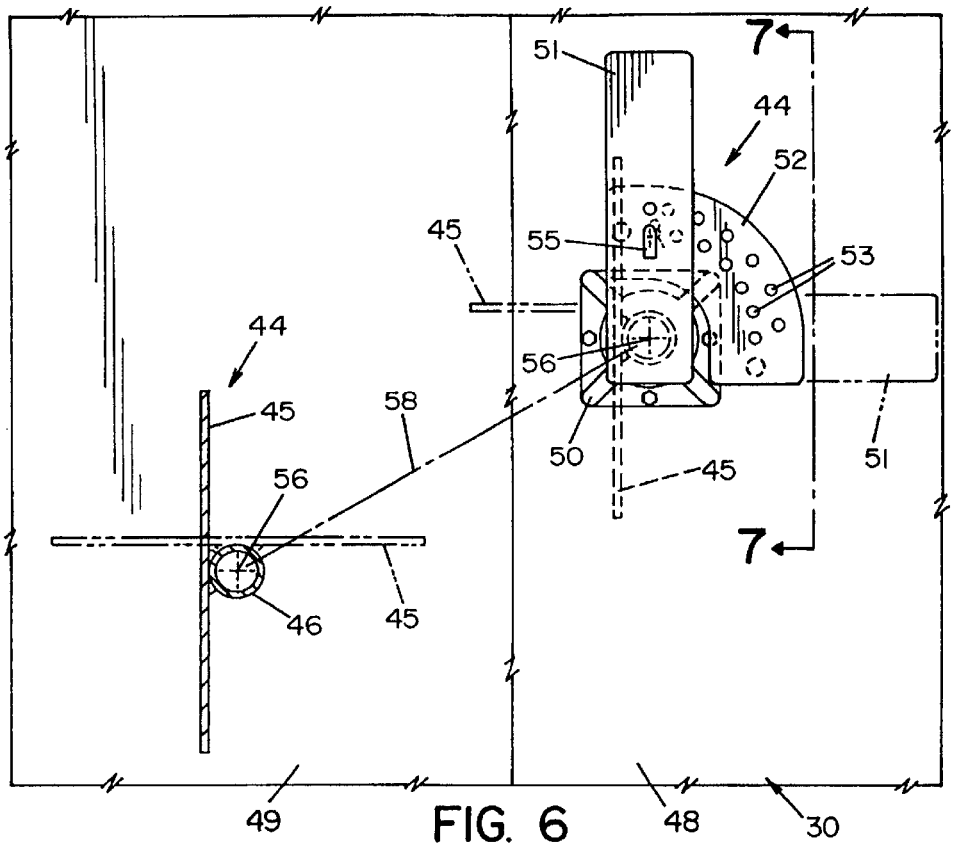
FIG. 6 is an elevation view, partially in section, of a portion of the intermediate section of the separator box of the present invention illustrating plates of the present invention.
Figure 7:
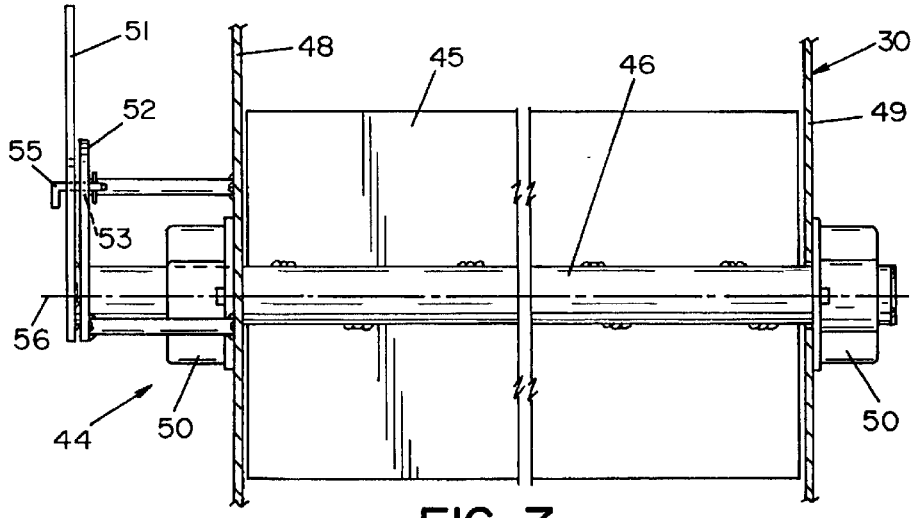
FIG. 7 is a transverse view of a baffle plate used in the present invention taken in the direction of line 7—7 of FIG. 6.

Referring now to FIGS. 1, 6 and 7, intermediate section 30 has a plurality of adjustable baffle plates 44 transversely spaced along the width thereof. Each baffle plate 44 simply comprises a flat plate 45 welded to a pipe 46 which is journaled or rotatable within openings formed in opposing side walls 48, 49 of intermediate section 30. Elastomer seal slip nuts 50 (such as available by Seal Master Co., Model SF-31 in the embodiment illustrated) fit over the pipe ends on the outside of side walls 48, 49 allowing pipe 46 to rotate while sealing the space between the pipe opening in side walls 48, 49 and pipe 46. Various arrangements can be provided to rotate pipe 46 so as to cause accurate positioning of plate 45 within intermediate section 30 reducing the cross-sectional flow area therethrough at the baffle plate position. In the embodiment illustrated, an actuator leaver 51 having a locking hole is affixed to one end of pipe 46. Secured as by weldment to the outside surface of the intermediate section side wall 48 adjacent actuating leaver 51 is an alignment plate 52 having a plurality of radially spaced aligning holes 53. Inserting a locking pin 55 through the locking hole into one of the aligning holes 53 in aligning plate 52 provides an accurate mechanism to position plate 45 at a fixed angle within intermediate section 30. Other baffle embodiments will suggest themselves to those skilled in the art and may be used in place of adjustable baffle plate 44. The arrangement illustrated however is economical and easy to adjust.

In the embodiment illustrated, the width of plate 45 is approximately 1 foot and the plates are transversely spaced at equal increments along the width of intermediate section 30 which, as noted, is approximately 8 feet. Thus, with the plates orientated in their completely closed position, i.e., the phantom position shown for the lower baffle 44 in FIG. 6, the cross-sectional flow-through area at the baffle elevation in intermediate section 30 would not be closed off. As noted, plates 45 extend the depth of intermediate section 30 as shown in FIG. 7, i.e., 4 feet in the embodiment illustrated.

Pipes 46 extend along a centerline 56 and separator box 14 will function with any vertical positioning of centerlines 56 for the plurality of baffle plates 44 illustrated. However, it is preferred as shown in FIG. 1 that the baffle plate 44A horizontally furthest from separator box inlet 42 be at the lowest vertical elevation in intermediate section 30 while the baffle plate 44F, which is horizontally closest to separator box inlet 42, be at the highest vertical elevation in intermediate section 30. More particularly, a plane can be constructed which contains centerlines 56 of all baffle plates 44A–44F. Conceptually, the plane could be arcuate struck along a radius extending from the center of separator box inlet 42. In the embodiment illustrated, and as best shown in FIG. 1, pipe centerlines 56 lie in a vertically inclined linear plane designated by dot-dash line 58 which is set at an angle to the horizontal, i.e., vertically inclined angle such that the distance from the separator inlet to any of the baffle plates 44A–44F is approximately equal.

Adjacent dust collector outlet 35 is a dust collector system 60. Dust collector system 60 includes a bag house 61 containing a conventional flow through bag filter and a fan 62, such as a squirrel cage blower fan, downstream of bag house 61. Fan 62 and bag house 61 are entirely conventional and will not be described further. The speed of fan 62 is variably set by the operator of air classifier 10 through known controls. That is, when air classifier 10 is operating, the speed of fan 62 will be constant and non-variable. However, depending on the size of the particles to be collected at classifier outlet 28 the speed of fan 62 will have to be set to a speed which produces a desired underpressure in separator box 14. That is, fan speed will be set to produce a slight underpressure upstream of baffle plates 44 in intermediate section 30 which will typically be between 1 to 3 inches water column. The speed of fan 62 would not be such so as to draw a vacuum or underpressure in excess of 5 inches water column in separator box 14.

Figure 4:
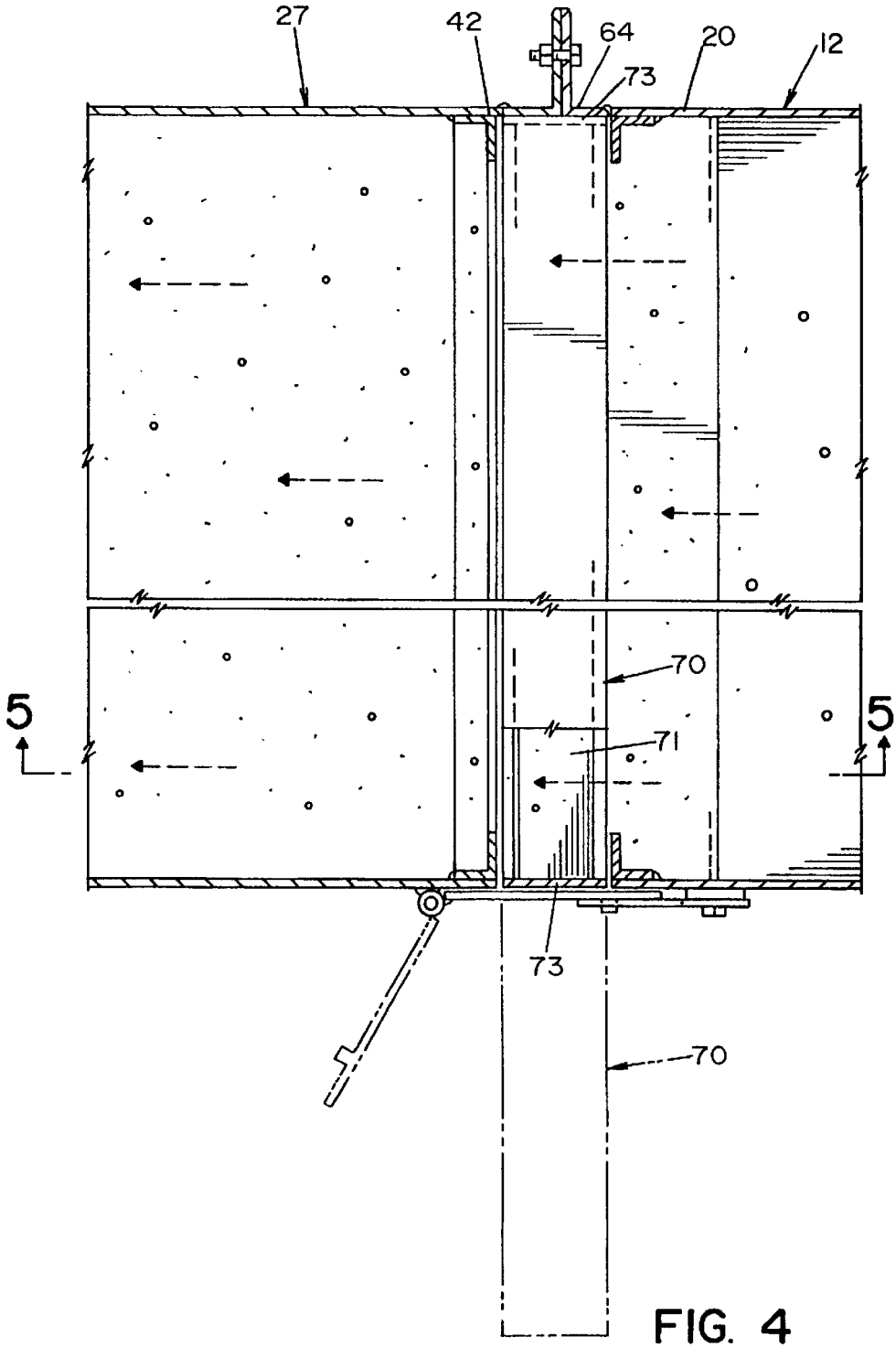
FIG. 4 is a sectioned plan view of the separator box inlet and feed duct side opening of the present invention taken along lines 4—4 of FIG. 1.
Figure 5:
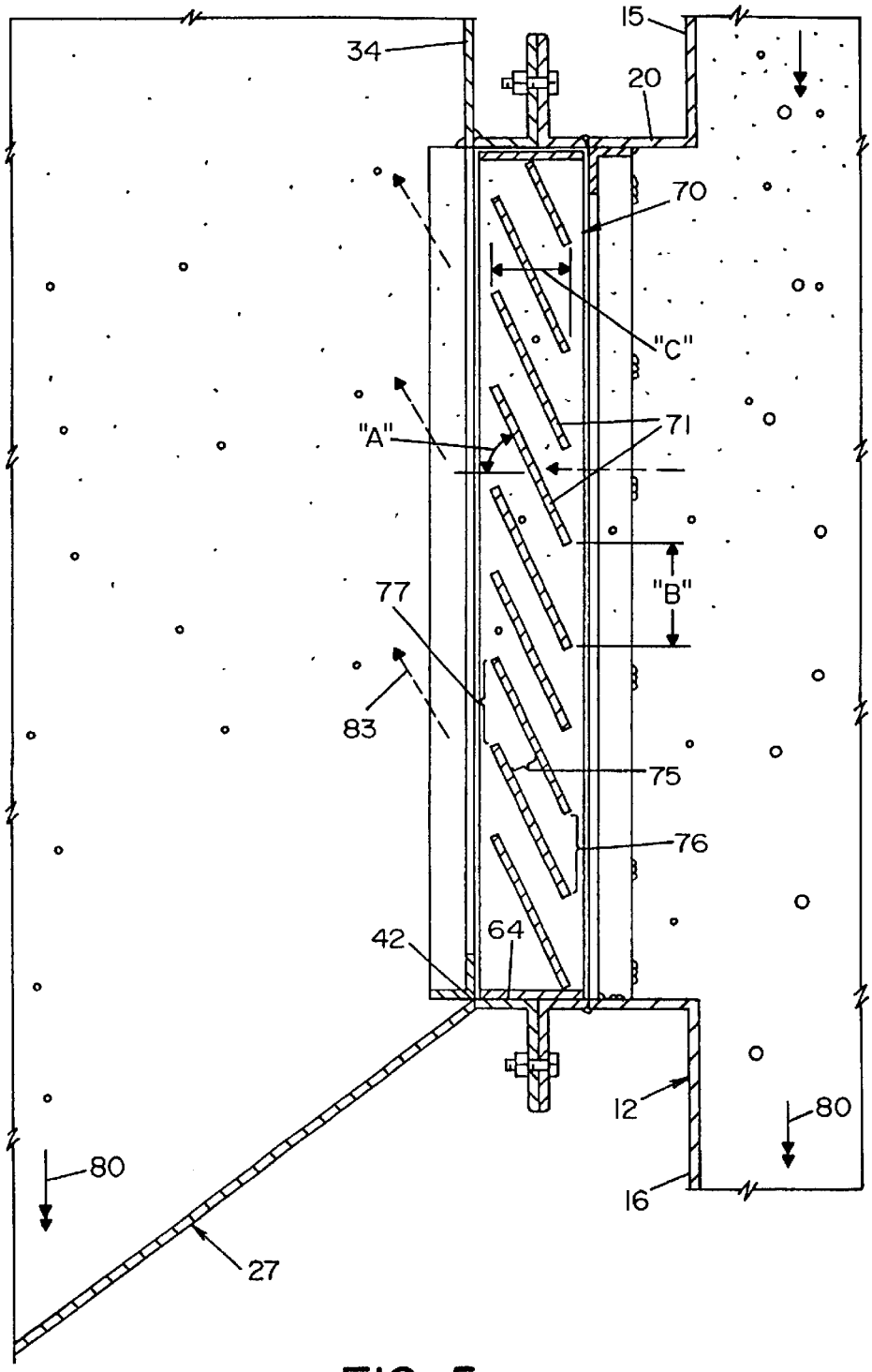
FIG. 5 is a sectioned elevation view of the classifying louver plate of the present invention taken along lines 5—5 of FIG. 4.
Figure 8:
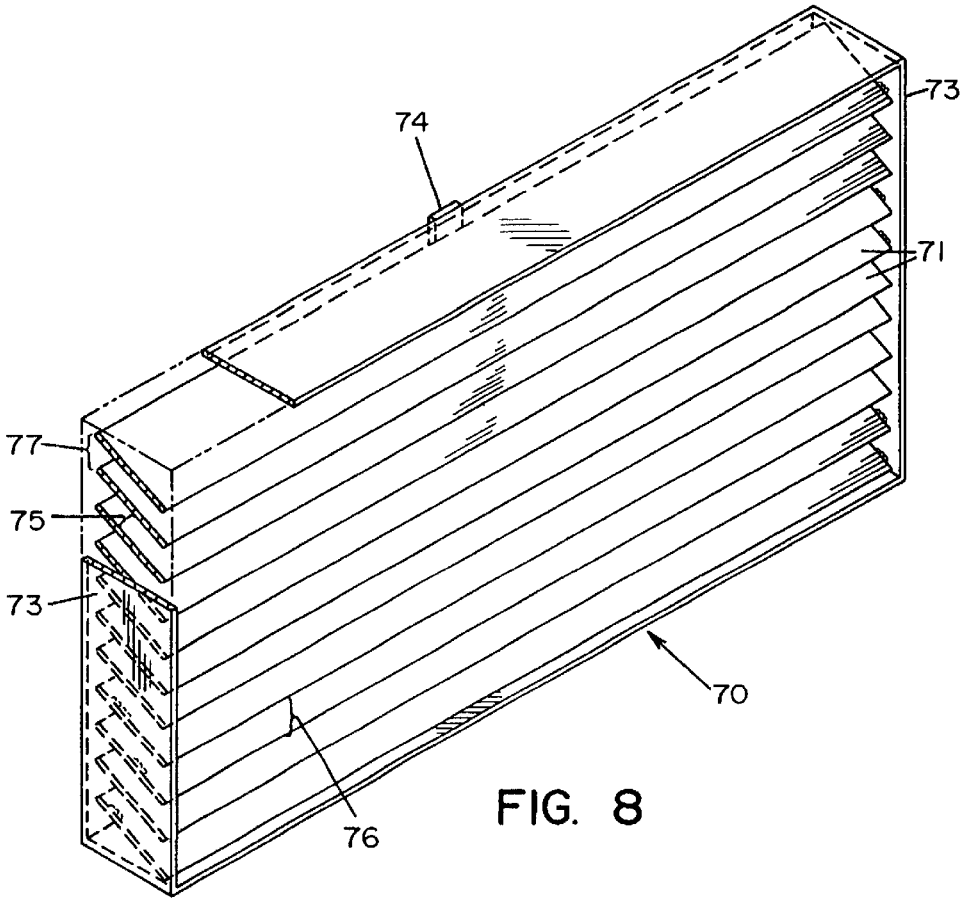
FIG. 8 is a perspective view of the classifying louver plate of the present invention; and, FIGS. 9–14 are elevation view of various louver classifying plates having different fin geometries which may be employed in the present invention.
Figure 9:
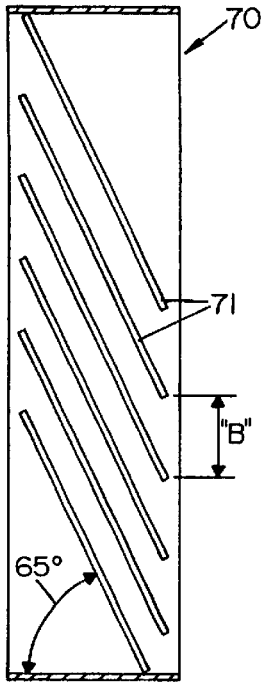
Figure 10:
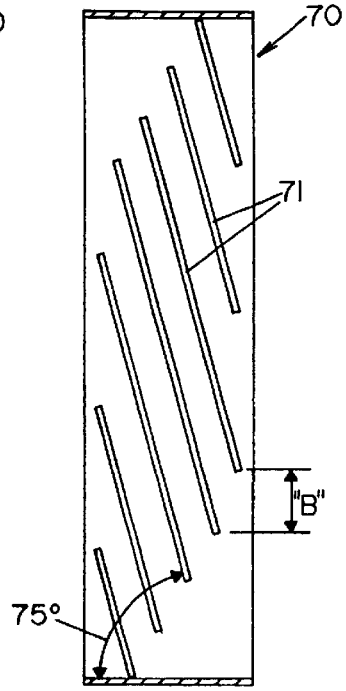
Figure 11:
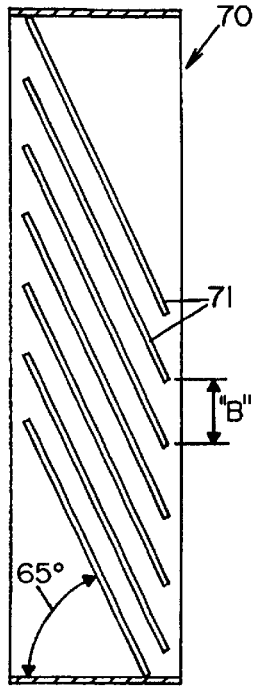

Referring now to FIGS. 4, 5 and 8, positioned within a horizontally extending casing mount 64 connecting separator box inlet 42 with side duct exit opening 20 is a classifying louver plate 70. The louvers or fins 71 formed in classifying louver plate 70 are vertically inclined in an upward direction, i.e., opposite to the downward flow of particulates in feed duct 12. As best shown in FIG. 8, classifying louver plate 70 is not formed in the classic sense of having louvers punched through a flat plate but comprises vertically inclined fins 71 secured at their ends to sides 73 of a box frame which can be slid into casing mount 64 such as shown in FIG. 4 and in a manner not entirely dissimilar to that in which a filter would be inserted into a domestic, house furnace. Because the fin length is about 4 feet long in the embodiment illustrated, a center back brace 74, preferably in the form of a thin rod, can be provided at the center of the fin length. As best shown in FIG. 5, adjacent fins form classifying channels 75, each of which has an entrance end 76 adjacent side duct exit opening 20 and an exit end 77 adjacent separator box inlet opening 42. Each classifying channel is vertically inclined in the preferred embodiment at the angle of the vertically extending fin 71 which defines the channel. In the preferred embodiment, the vertically inclined angle which is formed with the horizontal and is designated by reference letter "A" in FIG. 5 is to be at least about 70° or higher. It is recognized that channel spacing as indicated by reference letter "B" in FIGS. 5, 9, 10 and 11 will also affect the performance of air classifier 10 as will the depth of the channels as indicated by reference letter "C" in FIG. 5. The vertically inclined angle "A" is the most important parameter in the design of classifying louver plate 70. That is, particle separation can be effected at vertical angles at little as 45–55°, i.e., particles within the discrete range size can be collected with fins 71 at this angle. However, if particles within various size ranges are to be discriminately separated and collected by simply varying speed of fan 62, it has been determined that the vertically inclined angle must be at least 65° to give the desired control for separating and collecting a variety of particle size ranges and preferably 70° or more.

In describing static air classifier 10 dimensions of a prototype air classifier have been set forth. In fact, certain drawings, such as FIGS. 1, 2, 3 and 4 are drawn approximately to scale. The scale reference is set forth to show the relative sizing of the components which affects the performance of air classifier and its ability to separate and collect particles at various rotational fan speeds. For example, the flow area of classifying louver plates is approximately 8 $ft^2$ and the cross-sectional flow area of intermediate section 30 of separator box 14 is approximately 32 $ft^2$ indicating the velocity of the air stream thought intermediate section 30 is ¼th the velocity of air stream through classifying louver plate 70 since fan 62 will draw a constant CFM flow when operating. This relationship was found acceptable in the preferred embodiment illustrated but classifier 10 can be designed with other relationships and the invention is not necessarily limited to the disclosed sizing relationships. Similarly, separator box 14 is shown rectangular with funneling, frusto-conical or pyramidal sections which has been determined to be preferred for a number of reasons. However, the invention is not limited to a rectangular configuration. For example, a cylindrical construction can be had.

OPERATION

Static air classifier 10 operates in two distinct stages. In the first stage, particles of a desired size are separated from other particles of a larger size by passing the particles through classifying louver plate 70. In the second stage, the separated particles are collected within a size range in separator box 14. Generally speaking, these stages are caused to occur by operating fan 62 at a desired speed causing a set volumetric flow of air through air classifier 10, i.e., x cubic feet per minute. By sizing the structure as discussed above, the air velocity through air classifier 10 varies to cause separation and collection of particles of desired size.

More particularly, granular material is fed into duct inlet 15 by feeder 18 and falls as a generally steady stream of particles by gravity through feed duct 12 to oversize particles outlet 16 where it is collected and removed as indicated by double arrowhead arrows 80 in FIG. 1. Fan 62 draws a stream of outside air through side air inlet opening 21 (indicated by solid arrows 82 in FIG. 1), across the path of the falling particles in duct 12, past side duct opening 20 and into classifying louver plate 70. This air drawn into duct 12 entrains particles in its path and attempts to draw the entrained particles through the vertically inclined classifying channels 72 and out into separator box 14. The entrainment is a function of the velocity of the incoming air stream and that, in turn, is a function of the cross-sectional flow area of the side duct inlet and exit openings 20, 21 and the cross-sectional flow area of the total area of the classifying channels 75 which, in turn, is a function of the fan draw, i.e., cubic feet/minute or cubic feet/hour. The higher the velocity the larger the particle size that can be maintained in an entrained state with the air flow through classifying louver plate 70. Because of the inclined angle of fins 71, the horizontally drawn air cannot "see" classifying channel exit end 77 from classifying channel inlet end 76. The drawn air has to impact fins 71. When the entrained particles impact fins 71, the particles will disassociate from the air stream. The smaller, lighter particle will immediately re-establish entrainment with the air stream that passes through classifying louver plate 70. The larger, heavier particles will break entrainment with the air stream and fall by gravity to oversize discharge outlet 16, all as a function of air flow velocity. Importantly, and again, upward incline angle of classifying channel 75 is opposite to the downward flow of particles within feed duct 12 and is set steep enough so that invariably the particles in the air streams impinge fins 71. That is, the air is drawn horizontally through the vertically extending feed duct 12 and its horizontal flow cannot transverse channel entrance end 76 to channel exit end 77 without contacting fins 71. Surprisingly, it has been determined that by controlling the speed of fan 62 to a desired set value, particles (of a homogenous material) of a set size or smaller leaving classifying louver 70 can be controlled. Having separated the particles by size, vis-a-vis classifying louver plates 70, the next stage is to collect the particles. However, those skilled in the art will recognize that if the end use of the classified particles only required that particles be collected of a size not exceeding a set size and without any further requirement that the collected particle be within a maximum-minimum range, then a collection outlet can simply be provided at the outlet of classifying louver plate 70. The separation process is complete once the entrained particles leave classifying channel outlets 77.

In the second stage however, the separated particles (from the first stage) can be collected within a size range. This is essentially accomplished by sizing the separator box such as by the dimensions in the embodiment illustrated so that the cross-sectional flow area in the box through which the particles flow is significantly increased resulting in a diminishing of the air velocity. The reduced air velocity allows the smaller size particles which passed through classifying louver plate 70 to fall by gravity as the air streams are pulled upward in vertical separator box 14 to dust collector outlet 25. The smaller size particles fall to classifier outlet 28 (indicated by double headed arrows 80 in FIG. 1) where they are collected by any conventional means.

To enhance the collection of the smaller size particles, baffle plates 44 are provided and they are provided on a line or plane 58 which is equally distant from separator box inlet 42 representing the effective cross-sectional flow area of separator box 14. When plates 45 are oriented toward a closed position, the upward flowing air streams with entrained particles impinge the baffle plates and cause a recirculation of the air streams downstream of the baffle plate in the separator box as shown by the dashed flow arrows designated by reference numeral 83 (indicating air streams with entrained particles) in FIG. 1. This increases box residence time allowing further particle separation to occur. More significant, or as important, the baffles acting together in their plane function as an orifice slowing air flow downstream of the baffles and allowing more particles to separate from the air stream and be collected at classifier outlet 28. That is, velocity beneath the baffles is slower than velocity in separator box 14 above the baffles. It has been determined that the amount or quantity of fines collected in classifier outlet 28 is a function of baffle plate position. That is, the content of the fines collected with the classified particles (for that matter the size range of the smaller particles passing through classifying louver plate 70 from the "largest" to a "set" smallest) can be controlled to meet customer specification by baffle plate position. However, dust particles for the most part will invariably pass through dust collector outlet 25 and be collected in bag house 61 irrespective of baffle position. That is, dust and other lighter, foreign particles will not be collected improving the quality of the separated and collected particles. It is of course to be recognized that the subject matter under discussion involves a granular mixture containing numerous particles and separation and collection is discussed in relative and not absolute terms. Some dust will be collected. Some smaller sized particles will migrate to the bag house 61 and some larger sized particles will pass through classifying louver plate 70. However, substantially all of the particles passing through classifying louver plate 70 will be the smallest sized particles set by the air flow, etc.

Conceptually, the invention may function if the air was "pushed" through the classifying louver plate 70 and separator box 14 such as by locating fan 62 at feed duct air inlet 21. In practice, such an arrangement is not preferred and is not desired for control stability purposes. That is, pushing the air streams requires the static pressure of stationary downstream air to be overcome while drawing or pulling air requires static pressure of stationary upstream air to be overcome. In the pull or suction arrangement, the entrainment occurs downstream of stationary air. When the air flows in separator box 14 the air streams remain laminar and controllable, and collected of separated particles (particles not exceeding a maximum size) within a desired range (between the maximum separated size and a controllable minimum size) is possible. It is also preferred that the air be drawn and not pushed through the classifying louver plate 70. Air streams drawn through classifying louver plate 70 will impinge upon fines 71 and produce eddy currents. If the eddy currents become strong, turbulent flow will occur and separating particles by size under turbulent flow conditions is not practical. Drawing the air streams through classifier louver plate 70 is believed to result in better control of the eddy currents and minimization of turbulent flow conditions than that which would otherwise occur in a push flow arrangement. In point of fact, fins 71 act as straighteners enhancing laminar flow in the drawn air arrangement disclosed.

Finally, as discussed in the Background, horizontal tunnel arrangements are difficult to control. The horizontal air stream passing through the vertically falling stream of particles has to be very precisely controlled. It must have a sufficient velocity to collect a mass of particles and then sufficient momentum balanced against decay properties to allow particles of varying sizes to fall out and be collected along the path of the air stream which has to be laminar. This is extremely difficult and especially so if the particle size of the granular mixture varies from one batch of raw product mix to the other. Inherently, the air has to be directed through movable baffles to control its velocity in addition to fan speed. The problem is simply not present in the invention because of the function of classifying louver plate 70 in the first stage and separated control of the collection of the separated product vis-a-vis adjustable baffle plates 44 in the second stage.

In summary, air classifier 10 is a two-stage static air separator for producing sand. Separations can be made at between 350–1000 microns, and at between 17–150 microns. The unit is static in that it has no moving part. Most air classifiers have moving parts which require maintenance and also usually are subject to high wear. Air classifier 10 uses moving air to affect its separations. The pressure drop across the unit is low enough that direct connection with the dust collector and fan 62 provide sufficient flow.

Feed is introduced to feed duct 12 across the full width of the feed duct with the vibratory feeder 18. Air, moving horizontally, draws product size material from the feed stream into the louvers. The louvers 71 are installed at approximately 75° to the horizontal. Near sized material impinges on the louvers and drops back into the course stream. Material substantially finer than the separation size does not impinge on the louvers, but is simply drawn through with the air. The separation sizes are determined by the air flow. More air results in a coarse product, less air, finer. The spacing and the angle of the louver blades can be adjusted as well, but once established for an application, they are unlikely to be adjusted.

Having gone through the louvers, the sand laden air enters separator box 14. The separator box is equipped with movable baffles 44 which also act as impingement plates. These insure that the air flow is thoroughly distributed across the chamber to result in a sufficiently low air velocity to allow the sand to drop out. The velocity, however, remains high enough to retain the dust particles. The fines content of the sand can be adjusted by moving the baffles. Allowing higher velocity zones to form will decrease sand fines content. Minimizing the high velocity and stabilizing air flow will increase sand fines content. Air classifier 10 is primarily intended to replace screens operating in closed circuit with crushers. In this application, they have over doubled the capacity of similar width screens and are much easier to operate. They are not subjected to blinding, as screens are, and their cut size can be readily adjusted while running. A 4 foot wide unit making a separation at approximately 600 microns requires 6000 cubic feet per minute of air flow.

Figure 12:
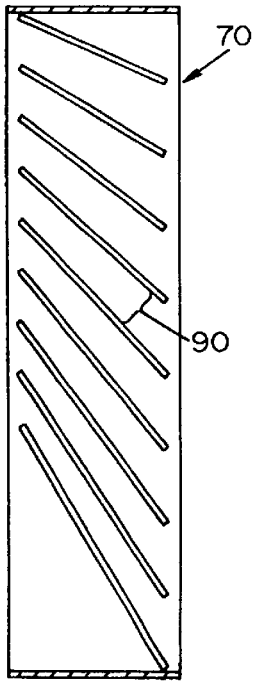
Figure 13:
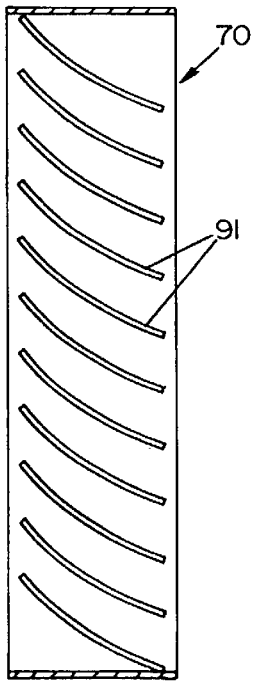
Figure 14:
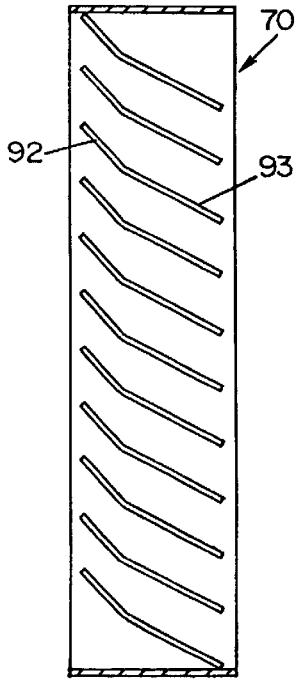

The invention as been described with reference to a preferred embodiment. Obviously, modifications and alterations will occur to those skilled in the art upon reading and understanding the Detailed Description of the Invention set forth above. For example, various fin configurations of classifying louver plate 70 can be affected. The fins can be formed so that classifying channels 90 narrow from inlet to exit as shown in FIG. 12. Alternatively, fins 91 can be curved or arcuate as shown in FIG. 13. Arcuate fins increase the vertically inclined path of the particles traveling therethrough. Still yet, two stage fins 92, 93 as shown in FIG. 14 may be employed. Forming the exit portion of fin 92 at a steeper inclined angle could conceivably aid in the separation. The width of classifying channels 75 can also vary. While different classifying louver plates 70 can be easily inserted into air classifier 10 as shown by the door entrance in FIG. 4 to allow a "customized" separation process, it is believed that once a classifying louver 70 has been designed for a particular granular medium, the classifying louver plate will not change for different particle sizes to be separated by the classifier. It is intended to include all such modifications insofar as they come within the scope of the present invention.

Having thus defined the invention, it is claimed:

1. A device for separating and classifying particles of a homogeneous granular mixture comprising:

a feed duct having a feed inlet, a particle discharge outlet, a side particle opening and a side gas inlet opening, both of which are positioned between the feed inlet and the particle discharge outlet, said gas inlet opening designed to allow gas to flow into said feed duct and to direct a portion of said homogeneous granular mixture through said side particle opening as said homogeneous granular mixture moves from said feed inlet toward said particle discharge outlet;

a separator box having a top section with a dust collector outlet, a bottom section with a classifier outlet and an intermediate section therebetween, said bottom section including a particle inlet fluidly connected to said particle opening of said feed duct;

a classifying louver plate positioned between said particle inlet of said separator box and said particle opening of said feed duct, said classifying louver plate including a plurality of fins defining classifying channels between adjacently positioned fins; and, a fan designed to cause a flow of gas from said particle inlet, into said separator box and upwardly to said dust collector outlet.

2. The device as defined in claim 1, wherein at least one of said plurality of fins of said classifying louver plate is adjustable so that a particular orientation angle of such fin can be selected.

3. The device as defined in claim 1, wherein at least one of said plurality of fins of said classifying louver plate has an angle of at least about 45° relative a horizontal plane extending between said particle inlet of said separator box and said particle opening of said feed duct.

4. The device as defined in claim 2, wherein at least one of said plurality of fins of said classifying louver plate has an angle of at least about 45° relative a horizontal plane extending between said particle inlet of said separator box and said particle opening of said feed duct.

5. The device as defined in claim 1, wherein said intermediate section includes a plurality of spaced baffle plates transversely extending across said intermediate section.

6. The device as defined in claim 4, wherein said intermediate section includes a plurality of spaced baffle plates transversely extending across said intermediate section.

7. The device as defined in claim 5, wherein at least one spaced baffle plate is angularly adjustable.

8. The device as defined in claim 6, wherein at least one spaced baffle plate is angularly adjustable.

9. The device as defined in claim 5, wherein a plurality of said spaced baffle plates are spaced apart from one another along a vertical axis and a horizontal axis of said separator box, said baffle plate having a smallest vertical distance along the vertical axis from said particle inlet being spaced a largest distance along the horizontal axis from said particle inlet, said baffle plate having a largest vertical distance along the vertical axis from said particle inlet being spaced a smallest distance along the horizontal axis from said particle inlet.

10. The device as defined in claim 1, wherein said bottom section includes a plurality of collecting ribs.

11. The device as defined in claim 9, wherein said bottom section includes a plurality of collecting ribs.

12. The device as defined in claim 10, wherein at least a portion of said plurality of collecting ribs is positioned on a wall surface opposite said particle inlet of said separator box.

13. The device as defined in claim 11, wherein at least a portion of said plurality of collecting ribs is positioned on a wall surface opposite said particle inlet of said separator box.

14. The device as defined in claim 10, wherein an inclined angle of at least one of said collecting ribs relative to a horizontal plane extending between said particle inlet of said separator box and said particle opening of said feed duct is at least about 55°.

15. The device as defined in claim 13, wherein an inclined angle of at least one of said collecting ribs relative to said horizontal plane extending between said particle inlet of said separator box and said particle opening of said feed duct is at least about 55°.

16. The device as defined in claim 1, wherein said fan has an adjustable speed to control said gas flow into said separator box through said particle inlet and upwardly through said duct collector outlet.

17. The device as defined in claim 15, wherein said fan has an adjustable speed to control said gas flow into said separator box through said particle inlet and upwardly through said dust collector outlet.

18. The device as defined in claim 1, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

19. The device as defined in claim 17, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

20. The device as defined in claim 1, including a feeder designed to deposit a stream of said homogeneous granular mixture through said feed inlet.

21. The device as defined in claim 19, including a feeder designed to deposit a stream of said homogeneous granular mixture through said feed inlet.

22. The device as defined in claim 20, wherein said feeder includes a vibratory conveyor.

23. The device as defined in claim 21, wherein said feeder includes a vibratory conveyor.

24. The device as defined in claim 5, wherein said spaced baffle plates in said intermediate section designed to cause underpressure upstream of said baffle plates of at least about 1 inch water column.

25. The device as defined in claim 23, wherein said spaced baffle plates in said intermediate section designed to cause underpressure upstream of said baffle plates of at least about 1 inch water column.

26. A device for separating and classifying particles of a homogeneous granular mixture comprising:

a feed duct having a feed inlet, a particle discharge outlet, a side particle opening and a side gas inlet opening both of which are positioned between the feed inlet and the particle discharge outlet, said gas inlet opening designed to allow gas to flow into said feed duct and to direct a portion of said homogeneous granular mixture through said side particle opening as said homogeneous granular mixture moves from said feed inlet toward said particle discharge outlet;

a separator box having a top section with a dust collector outlet, a bottom section with a classifier outlet and an intermediate section therebetween, said bottom section including a particle inlet fluidly connected to said particle opening of said feed duct, said intermediate section including a plurality of spaced baffle plates transversely extending across said intermediate section; and, a fan designed to cause a flow of gas from said particle inlet, into said separator box and upwardly to said dust collector outlet.

27. The device as defined in claim 26, including a classifying louver plate positioned between said particle inlet of said separator box and said particle opening of said feed duct, said classifying louver including a plurality of fins defining classifying channels between adjacently positioned fins.

28. The device as defined in claim 27, wherein at least one of said plurality of fins of said classifying louver plate is adjustable so that a particular orientation angle of such fin can be selected.

29. The device as defined in claim 27, wherein at least one of said plurality of fins of said classifying louver plate has an angle of at least about 45° relative a horizontal plane extending between said particle inlet of said separator box and said particle opening of said feed duct.

30. The device as defined in claim 28, wherein at least one of said plurality of fins of said classifying louver plate has an angle of at least about 45° relative a horizontal plane extending between said particle inlet of said separator box and said particle opening of said feed duct.

31. The device as defined in claim 26, wherein at least one spaced baffle plate is angularly adjustable.

32. The device as defined in claim 30, wherein at least one spaced baffle plate is angularly adjustable.

33. The device as defined in claim 26, wherein a plurality of said spaced baffle plates are spaced apart from one another along a vertical axis and a horizontal axis of said separator box, said baffle plate having a smallest vertical distance along the vertical axis from said particle inlet being spaced a largest distance along the horizontal axis from said particle inlet, said baffle plate having a largest vertical distance along the vertical axis from said particle inlet being spaced a smallest distance along the horizontal axis from said particle inlet.

34. The device as defined in claim 32, wherein a plurality of said spaced baffle plates are spaced apart from one another along a vertical axis and a horizontal axis of said separator box, said baffle plate having a smallest vertical distance along the vertical axis from said particle inlet being spaced a largest distance along the horizontal axis from said particle inlet, said baffle plate having a largest vertical distance along the vertical axis from said particle inlet being spaced a smallest distance along the horizontal axis from said particle inlet.

35. The device as defined in claim 26, wherein said bottom section includes a plurality of collecting ribs.

36. The device as defined in claim 34, wherein said bottom section includes a plurality of collecting ribs.

37. The device as defined in claim 35, wherein at least a portion of said plurality of collecting ribs is positioned on a wall surface opposite said particle inlet of said separator box.

38. The device as defined in claim 36, wherein at least a portion of said plurality of collecting ribs is positioned on a wall surface opposite said particle inlet of said separator box.

39. The device as defined in claim 35, wherein an inclined angle of at least one of said collecting ribs relative to a horizontal plane extending between said particle inlet of said separator box and said particle opening of said feed duct is at least about 55°.

40. The device as defined in claim 38, wherein an inclined angle of at least one of said collecting ribs relative to said horizontal plane extending between said particle inlet of said separator box and said particle opening of said feed duct is at least about 55°.

41. The device as defined in claim 26, wherein said fan has an adjustable speed to control said gas flow into said separator box through said particle inlet and upwardly through said dust collector outlet.

42. The device as defined in claim 40, wherein said fan has an adjustable speed to control said gas flow into said separator box through said particle inlet and upwardly through said dust collector outlet.

43. The device as defined in claim 28, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

44. The device as defined in claim 43, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

45. The device as defined in claim 28, including a feeder designed to deposit a stream of said homogeneous granular mixture through said feed inlet.

46. The device as defined in claim 44, including a feeder designed to deposit a stream of said homogeneous granular mixture through said feed inlet.

47. The device as defined in claim 45, wherein said feeder includes a vibratory conveyor.

48. The device as defined in claim 46, wherein said feeder includes a vibratory conveyor.

49. The device as defined in claim 28, wherein said spaced baffle plates in said intermediate section are designed to cause underpressure upstream of said baffle plates of at least about 1 inch water column.

50. The device as defined in claim 48, wherein said spaced baffle plates in said intermediate section are designed to cause underpressure upstream of said baffle plates of at least about 1 inch water column.

51. A method for classifying particles of a granular medium by size comprising the steps of:

providing a feed duct having a feed inlet, a particle discharge outlet, a side particle opening and a side gas inlet opening both of which are positioned between the feed inlet and the particle discharge outlet;

providing a louver classifying plate that is fluidly connected to said side particle opening of said feed duct, said classifying louver including a plurality of fins defining classifying channels between adjacently positioned fins;

providing a separator box fluidly connected to said louver classifying plate, said separator box including a top section with a dust collector outlet, a bottom section with a classifier outlet and an intermediate section therebetween;

feeding the granular medium into a feed duct;

directing gas to a side gas inlet opening to cause a portion of said granular medium being fed though said feed duct to become entrained in said gas and be directed through said louver classifying plate and into said separator box thereby causing a separation of particles in said feed duct; and, directing at least a portion of said granular medium that is fed into said separator box upwardly in said separator box to contact a plurality of spaced baffle plates positioned above said louver classifying plate to further separate said granular medium.

52. The method as defined in claim 51, including the step of providing a fan designed to cause a flow of gas from said particle inlet.

53. The method as defined in claim 51, including the step of adjusting at least one of said fins of said classifying louver plate to at least partially control an average particle size distribution of said granular medium being fed into said separator box.

54. The method as defined in claim 52, including the step of adjusting at least one of said fins of said classifying louver plate to at least partially control an average particle size distribution of said granular medium being fed into said separator box.

55. The method as defined in claim 51, wherein at least one of said plurality of fins of said classifying louver plate has an angle of at least about 45° relative a horizontal plane extending between said particle inlet of said separator box and said particle opening of said feed duct.

56. The method as defined in claim 53, wherein at least one of said plurality of fins of said classifying louver plate has an angle of at least about 45° relative a horizontal plane extending between said particle inlet of said separator box and said particle opening of said feed duct.

57. The method as defined in claim 51, including the step of transversely extending a plurality of said spaced baffle plate along a horizontal axis of said intermediate section to facilitate in causing separation of different sized particles of said granular medium being fed into said separator box.

58. The method as defined in claim 56, including the step of transversely extending a plurality of said spaced baffle plate along a horizontal axis of said intermediate section to facilitate in causing separation of different sized particles of said granular medium being fed into said separator box.

59. The method as defined in claim 57, including the step of angularly adjusting at least one spaced plate to alter an average particle size distribution of said granular medium being separated in said separator box.

60. The method as defined in claim 59, including the step of angularly adjusting at least one spaced baffle plate to alter an average particle size distribution of said granular medium being separated in said separator box.

61. The method as defined in claim 57, wherein a plurality of said spaced baffle plates are spaced apart from one another along a vertical axis and a horizontal axis of said separator box, said baffle plate having a smallest vertical distance along the vertical axis from said particle inlet being spaced a largest distance along the horizontal axis from said particle inlet, said spaced baffle plate having a largest vertical distance along the vertical axis from said particle inlet being spaced a smallest distance along the horizontal axis from said particle inlet.

62. The method as defined in claim 60, wherein a plurality of said spaced baffle plates are spaced apart from one another along a vertical axis and a horizontal axis of said separator box, said baffle plate having a smallest vertical distance along the vertical axis from said particle inlet being spaced a largest distance along the horizontal axis from said particle inlet, said baffle plate having a largest vertical distance along the vertical axis from said particle inlet being spaced a smallest distance along the horizontal axis from said particle inlet.

63. The method as defined in claim 51, including the step of providing said bottom section with a plurality of collecting ribs.

64. The method as defined in claim 62, including the step of providing said bottom section with a plurality of collecting ribs.

65. The method as defined in claim 63, wherein at least a portion of said plurality of collecting ribs is positioned on a wall surface opposite said particle inlet of said separator box.

66. The method as defined in claim 64, wherein at least a portion of said plurality of collecting ribs is positioned on a wall surface opposite said particle inlet of said separator box.

67. The method as defined in claim 56, including the step of adjusting a speed of said fan to control said gas flow into said separator box through said particle inlet and upwardly through said dust collector outlet.

68. The method as defined in claim 66, including the step of adjusting a speed of said fan to control said gas flow into said separator box through said particle inlet and upwardly through said dust collector outlet.

69. The method as defined in claim 51, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

70. The method as defined in claim 68, wherein said intermediate section of said separator box has a maximum cross-sectional area along a horizontal axis of said separator box, said particle inlet having a maximum cross-sectional area, said maximum cross-sectional area of said intermediate section of said separator box being greater than said maximum cross-sectional area of said particle inlet.

71. The method as defined in claim 51, including the step of providing a feeder designed to deposit a stream of said homogeneous granular mixture through said feed inlet.

72. The method as defined in claim 70, including the step of providing a feeder designed to deposit a stream of said homogeneous granular mixture through said feed inlet.

73. The method as defined in claim 71, wherein said feeder includes a vibratory conveyor.

74. The method as defined in claim 72, wherein said feeder includes a vibratory conveyor.

75. The method as defined in claim 57, including the step of adjusting said spaced baffle plates in said intermediate section to cause an underpressure upstream of said baffle plates of at least about 1 inch water column.

76. The method as defined in claim 74, including the step of adjusting said spaced baffle plates in said intermediate section to cause an underpressure upstream of said baffle plates of at least about 1 inch water column.

* * * * *